US005577731A

United States Patent [19]

Jones

[11] Patent Number: 5,577,731

[45] Date of Patent: Nov. 26, 1996

[54] METHOD OF PROGRESSIVE JACKPOT TWENTY-ONE WHEREIN THE PREDETERMINED WINNING ARRANGEMENT OF CARDS INCLUDE TWO ACES, THREE ACES AND FOUR ACES

[75] Inventor: Daniel A. Jones, Las Vegas, Nev.

[73] Assignee: Progressive Games, Inc., Ft. Lauderdale, Fla.

[21] Appl. No.: 506,222

[22] Filed: Jul. 24, 1995

[51] Int. Cl.[6] ..... A63F 1/00

[52] U.S. Cl. ..... 273/292

[58] Field of Search ..... 273/292, 309, 273/274

[56] References Cited

U.S. PATENT DOCUMENTS

| | | | |
|---|---|---|---|
| D. 105,610 | 8/1937 | Posey | D6/618 |
| D. 118,451 | 8/1939 | Radford | D21/26 |
| D. 183,007 | 6/1958 | Lord | D21/26 |
| D. 213,891 | 4/1969 | Schultz | D21/32 |
| D. 220,635 | 5/1971 | Boyer et al. | D21/30 |
| D. 245,717 | 9/1977 | Jessie | D21/32 |
| D. 263,975 | 4/1982 | Quiroga et al. | D21/37 |
| D. 311,474 | 10/1990 | Hoffman | D6/618 |
| 1,238,736 | 9/1917 | Barrett | 453/18 |
| 1,527,929 | 6/1924 | Simons | 273/139 |
| 1,763,476 | 6/1930 | Morris | 273/309 |
| 1,970,876 | 4/1933 | Anderson | 273/309 |
| 2,008,829 | 10/1935 | Israel | 273/148 A |
| 2,199,745 | 5/1940 | Harris | 273/309 |
| 3,011,789 | 12/1961 | Eliassen et al. | 273/287 |
| 3,269,503 | 8/1966 | Foster | 273/85 CP |
| 3,556,531 | 1/1971 | Elder | 273/143 R |
| 3,663,021 | 5/1972 | Whippo | 273/274 |
| 3,667,757 | 6/1972 | Holmberg | 273/274 |
| 3,689,071 | 9/1972 | Kucera | 273/281 |
| 3,796,433 | 3/1974 | Fraley et al. | 273/138 A |
| 3,825,255 | 7/1974 | Kennard et al. | 273/139 |
| 3,874,671 | 4/1975 | Smith | 273/254 |
| 3,876,208 | 4/1975 | Wachtler et al. | 273/138 A |
| 4,063,680 | 12/1977 | Leo | 232/1 D |
| 4,099,722 | 7/1978 | Rodesch et al. | 273/143 R |
| 4,232,866 | 11/1980 | Pennachio | 273/374 |
| 4,302,012 | 11/1981 | Di Giovanni et al. | 273/148 R |
| 4,305,586 | 12/1981 | Richards | 273/274 |
| 4,364,567 | 12/1982 | Goott | 273/237 |
| 4,397,469 | 8/1983 | Carter, III | 273/149 R |
| 4,518,001 | 5/1985 | Branham | 133/5 R |
| 4,531,187 | 7/1985 | Uhland | 364/412 |
| 4,575,085 | 3/1986 | Ollington | 273/138 A |
| 4,614,342 | 9/1986 | Takashima | 273/85 CP |
| 4,624,459 | 11/1986 | Kaufman | 273/143 R |
| 4,648,604 | 3/1987 | Horan | 273/292 |
| 4,651,997 | 3/1987 | Wood | 273/274 |
| 4,700,948 | 10/1987 | Okada | 273/143 R |
| 4,721,307 | 1/1988 | Okada | 273/143 R |
| 4,743,022 | 5/1988 | Wood | 273/85 CP |
| 4,756,531 | 7/1988 | DiRe et al. | 273/138 A |
| 4,759,549 | 7/1988 | Beckwith | 273/274 |
| 4,760,527 | 7/1988 | Sidley | 364/274 |
| 4,813,675 | 3/1989 | Greenwood | 273/138 A |

(List continued on next page.)

FOREIGN PATENT DOCUMENTS

| | | |
|---|---|---|
| 621599 | 4/1989 | Australia . |
| 628044 | 4/1989 | Australia . |
| 96049 | 4/1989 | Austria . |
| 1334983 | 3/1995 | Canada . |
| 133538 | 4/1995 | Canada . |
| 4792 | 6/1991 | Dominican Rep. . |
| 4793 | 6/1991 | Dominican Rep. . |
| 4825 | 3/1993 | Dominican Rep. . |
| 4999 | 8/1993 | Dominican Rep. . |
| 0338644 | 4/1989 | European Pat. Off. . |
| 2830216 | 1/1980 | Germany . |
| 3003376 | 8/1981 | Germany . |
| 68909992 | 4/1989 | Germany . |
| 135187 | 6/1988 | Japan . |
| 2097570 | 4/1982 | United Kingdom . |
| 2169736 | 7/1986 | United Kingdom . |
| 2184029 | 6/1987 | United Kingdom . |
| 9220417 | 11/1992 | WIPO . |
| 9310869 | 6/1993 | WIPO . |
| 9415684 | 7/1994 | WIPO . |
| 9521665 | 8/1995 | WIPO . |

OTHER PUBLICATIONS

Wisted's Califorina Blackjack, Commerce Casino, Commerce, CA 1992.

Winning Gamer, Issue #5, Feb. 1985, Pi Yee Press, LaJolla, CA.

Winning Gamer, Issue #6, Mar. 1985, Pi Yee Press, LaJolla, CA.

Winning Gamer, Issue #15, Dec. 1985, Pi Yee Press, LaJolla, CA.

Winning Gamer, Issue #19, Apr. 1986, Pi Yee Press, LaJolla, CA.

Winning Gamer, Issue #20, May 1986, Pi Yee Press, LaJolla, CA.

Winning Gamer, Issue #21, Jun. 1986, Pi Yee Press, LaJolla, CA.

Affidavit of John F. Acres, Oct. 4, 1993.

Affidavit of William Randall Adams, Oct. 4, 1993.

Affidavit of Derell M. Johns, Nov. 19, 1993.

(List continued on next page.)

*Primary Examiner*—Benjamin H. Layno

[57] ABSTRACT

The method of the present invention involves a conventional live casino or video machine type Twenty-One game (also known as Blackjack), in which, in addition to his normal wager, a player has the option of making an additional wager that becomes part of, and makes the player eligible to win, a jackpot, and most preferably, a progressive jackpot. If the player's Twenty-One hand comprises a particular, predetermined arrangement of cards, the player will win all, or part of, the amount of the progressive jackpot. In a Twenty-One game using any number of decks of cards, the predetermined winning arrangements of cards preferred in the present invention are four black or red Aces; three suited Aces; three unsuited Aces; two suited Aces; and two unsuited Aces, which preferably win, respectively, highest, second highest, third highest, fourth highest, and fifth highest amounts of the jackpot.

33 Claims, No Drawings

U.S. PATENT DOCUMENTS

| | | | |
|---|---|---|---|
| 4,836,546 | 6/1989 | DiRe et al. | 273/138 A |
| 4,836,553 | 6/1989 | Suttle et al. | 273/85 CP |
| 4,837,728 | 6/1989 | Barrie et al. | 273/412 |
| 4,861,041 | 8/1989 | Jones et al. | 273/292 |
| 4,948,134 | 8/1990 | Suttle et al. | 273/85 CP |
| 4,964,638 | 10/1990 | Ishida | 273/138 A |
| 5,007,519 | 4/1991 | Mercurio | 194/230 |
| 5,022,653 | 6/1991 | Suttle et al. | 273/85 CP |
| 5,042,818 | 8/1991 | Weingardt | 273/292 |
| 5,078,405 | 1/1992 | Jones et al. | 273/309 |
| 5,098,107 | 3/1992 | Boylan et al. | 273/292 |
| 5,112,060 | 5/1992 | Jones | 273/309 |
| 5,249,800 | 10/1993 | Hilgendorft et al. | 273/138 A |
| 5,257,810 | 11/1993 | Schorr et al. | 273/292 |
| 5,275,400 | 1/1994 | Weingardt et al. | 273/85 CP |
| 5,275,415 | 1/1994 | Wisted | 273/274 |
| 5,277,424 | 1/1994 | Wilms | 273/85 CP |
| 5,288,077 | 2/1994 | Jones | 273/292 |
| 5,288,081 | 2/1994 | Breeding | 273/292 |
| 5,364,104 | 11/1994 | Jones et al. | 273/292 |
| 5,364,105 | 11/1994 | Jones | 273/292 |
| 5,374,067 | 12/1994 | Jones | 273/292 |
| 5,377,973 | 1/1995 | Jones | 273/85 CP |
| 5,377,994 | 1/1995 | Jones | 273/309 |
| 5,380,012 | 1/1995 | Jones | 273/292 |
| 5,382,025 | 1/1995 | Sklansky et al. | 273/292 |
| 5,393,067 | 2/1995 | Paulsen et al. | 273/292 |

OTHER PUBLICATIONS

Affidavit of Terry Oliver, Nov. 22, 1993.

Affidavit of Nick Edward Greenwood, Nov. 23, 1993.

Affidavit of Michael Spencer Stone, Nov. 23, 1993.

Scarne, Scarne's Encyclopedia of Games, Harper & Row, N.Y., Copyright 1973, p. 381, 383 and title pages.

Scarne, Scarne's Encyclopedia of Games, Harper & Row, N.Y. Copyright 1973, p. 33–41 and title pages.

Scarne, Scarne's New Complete Guide to Gambling, Simon & Schuster, N.Y., Copyright 1961, pp. 450–445 and title pages.

Scarne, Scarne's Encyclopedia of Card Games, Harper & Row, N.Y., Copyright 1983, pp. 299–304, 383, and title pages.

W. B. Gibson, Hoyle's Modern Encyclopedia of Card Games, pp. 218–219, 369–370 (1974).

Casino Player, vol. IV, No. 12, Aug. 1993, "My Biggest Slot Jackpot", Stanford Wong.

Gaming Concepts, Inc. "Over/Under 13 Blackjack" brochure, 1988.

Casino Journal, vol. 8, No. 12, Dec. 1992, "Working Within The Systems: IGT's Linked progressive programs take leap to the tables", p. 10–15, 40, 41.

Casino Gaming, Sep. 1988, "Aruba Deals A New Game: Caribbean Stud Poker", pp. 12–13.

Casino Journal, vol. 8, No. 6, Jun. 1993, "So You Wanna Be A Gambler", pp. 1, 5.

Information Disclosure Statement, Apr. 7, 1988, Describing "Sklansky's Casino Poker" and Video Poker.

Coin Hopper Model CH–500 and Model N. DH–750/U1 Literature Asahi Seiko.

26 Jan., 1993 Statement of Grounds and Particulars, By John Huxley Ltd., In Opposition to Australian in Opposition to Australian Patent Application No. 628044.

State of New Jersey Casino Control Commission PRN 217205 Civil Action, IGT's Second Amended Petition for Authorization for the Implementation of the Game of Progressive 21, filed sometime after Aug. 4, 1992.

Review Journal, "Gamblers Take Chance at Million Dollar Payoff", By C. J. Boyer.

Winning Gamer, Issue #17, Feb. 1986, Pi Yee Press, LaJolla, CA.

Scarne, Scarne's Encyclopedia of Games, "Hold 'Em", Harper & Row Publishers, Copright 1973, p. 14–18, 26 Abercrinbue & Fitch, Play Hours, 1960, pp. 11, Blackjack Towel.

Scarne, Scarne's Encyclopedia of Card Games, copyright date unknown, p. 288.

Jim Kilby's Declaration Under 37 C.F.R. § 1.132.

TXU 184,603, Mar. 30, 1985.

TX 2,568,066, Mar. 6, 1989.

Scarne, Scarne's Guide to Modern Poker, copyright unknown, pp. 40, 60–61.

Request for Reexamination, U.S. Pat. No. 4,861,041; issued Aug. 29, 1989; Date of Service: Jun. 20, 1995.

Request for Reexamination, U.S. Pat. No. 5,288,077, issued Feb. 22, 1994; Date of Service May 26, 1995.

Request for Reexamination, U.S. Pat. No. 5,364,105, issued Nov. 15, 1994; Date of Service May 26, 1995.

Asahi Seiko Catalog No. AV89C, Aug. 20, 1989, pp. 44, 51 and Photograph "A".

Scarne, Scarne's Encyclopedia of Games, Copyright 1973, pp. 11, 31, 440–445.

Declaration of I. Nelson Rose, dated Jan. 26, 1989.

Declaration of Don Clark, dated Feb. 2, 1989.

Declaration of Dennis Robie, dated Jan. 27, 1989.

Declaration of Mark A. Sincox, dated Feb. 7, 1989.

Declaration of John Edward Roethel, dated Feb. 7, 1989.

Scarne, Scarne's Encyclopedia of Games, Harper & Row, Copyright 1973, title pages and pp. 33–37.

METHOD OF PROGRESSIVE JACKPOT TWENTY-ONE WHEREIN THE PREDETERMINED WINNING ARRANGEMENT OF CARDS INCLUDE TWO ACES, THREE ACES AND FOUR ACES

BACKGROUND OF THE INVENTION

U.S. Pat. No. 4,861,041 describes a method and apparatus for progressive jackpot gaming in which a separate bet is utilized in a Twenty-One game in connection with the provision of a jackpot component. As described in that patent, a player may make an optional additional wager to be eligible to participate in a separate progressive jackpot. If, during the play of the normal Twenty-One game, the player achieves a predetermined arrangement of cards, the player wins all or part of the progressive jackpot amount.

U.S. Pat. No. 5,288,077 discloses an alternative payout structure for a progressive jackpot component of a Twenty-One game, with the objective of providing predetermined winning arrangements of cards which do not interfere with the play of the underlying Twenty-One game.

The entire disclosures of the two aforementioned patents are incorporated by reference herein.

It is a feature of the present invention that predetermined arrangements of cards that constitute winning hands for a progressive jackpot component of a Twenty-One game are selected so that the predetermined arrangements of cards do not interfere with the play of the normal Twenty-One game.

It is an additional feature of the present invention that a player may attempt to achieve one of the predetermined arrangement of cards that will win all or part of the progressive jackpot component of the normal Twenty-One game without interfering with the normal play of the Twenty-One game.

SUMMARY OF THE INVENTION

The method of the present invention involves a conventional live casino or video machine type Twenty-One game (also known as Blackjack), in which, in addition to his normal wager, a player has the option of making an additional wager that becomes part of, and makes the player eligible to win, a jackpot, and most preferably, a progressive jackpot. If the player's Twenty-One hand comprises a particular, predetermined arrangement of cards, the player will win all, or part of, the amount of the progressive jackpot. In a Twenty-One game using any number of decks of cards, the predetermined winning arrangements of cards preferred in the present invention are four black or red Aces; three suited Aces; three unsuited Aces; two suited Aces; and two unsuited Aces, which preferably win, respectively, highest, second highest, third highest, fourth highest, and fifth highest amounts of the jackpot.

DETAILED DESCRIPTION OF PREFERRED EMBODIMENTS

The method of playing a Twenty-One game including a progressive jackpot component is described in detail in U.S. Pat. No. 4,861,041.

A conventional live casino Twenty-One game is conducted on a gaming table. At the beginning of each hand, each player, in addition to making his usual wager for the play of the Twenty-One hand, may also optionally make an additional optional wager to be eligible to participate in a progressive jackpot component of the game during the hand. At least a portion of each wager made to be eligible for the progressive jackpot is added to the running total of the progressive jackpot amount, preferably using electronic coin acceptors and signage as described in the '041 patent.

The amount shown on a progressive jackpot meter will continue to increase for each gaming token wagered until a player achieves a winning hand. Predetermined winning hands earn a player all or part of the amount shown on the progressive jackpot meter.

In a normal Twenty-One game, the dealer deals cards to the players and the dealer according to the normal method of play. One or more standard decks of playing cards may be used.

As discussed above, the preselected hands that are eligible for winning all or a portion of the progressive jackpot amount should not interfere with the play of the underlying Twenty-One game. In order to try and achieve a winning jackpot hand, a player should not have to choose between keeping a probable winning Twenty-One hand or taking additional cards to try and achieve a winning progressive jackpot hand.

In a preferred embodiment of the present invention, when the Twenty-One game uses any number of decks of conventional playing cards (from one deck to as many decks as the house desires to include in the game) which are then shuffled together, the preselected winning hands in the Twenty-One game are as follows:

TABLE 1

| Winning Hand | Amount of Jackpot |
|---|---|
| 4 black or 4 red Aces | highest amount |
| 3 suited Aces | second highest amount |
| 3 unsuited Aces | third highest amount |
| 2 suited Aces | fourth highest amount |
| 2 unsuited Aces | fifth highest amount |

As used in this specification, "suited" means that each of the designated cards must be of the same card suit—Spades, Hearts, Diamonds or Clubs. "Unsuited" means that at least two of the cards of the hand are of different suits. In each instance, the predetermined winning arrangement of cards must consist of only the first cards received by the player. For example, to achieve a winning hand of 2 suited Aces, the player's first two cards must be 2 suited Aces. A player receiving an Ace and a 5 for the first two cards, and another Ace as their third card, would not have a winning hand for the jackpot.

The amounts paid for the various winning hands are not critical but should be determined based on conventional percentage controls methods so that the house maintains a reasonable profit from the operation of the game. In most regulated gaming jurisdictions, the house percentage should not exceed 15% on a theoretical hold basis.

In a more preferred embodiment of the prevent invention when the Twenty-One game uses any number of decks of conventional playing cards (from one deck to as many decks as the house desires to include in the game) which are then shuffled together, the preselected winning hands and payoff amounts in a Twenty-One game are as follows:

TABLE 2

| Winning Hand | Amount of Jackpot |
|---|---|
| 4 black or 4 red Aces | 100% |
| 3 suited Aces | 2500 tokens |
| 3 unsuited Aces | 250 tokens |
| 2 suited Aces | 100 tokens |
| 2 unsuited Aces | 25 tokens |

Table 3 below illustrates statistical odds and payoffs for the inventive jackpot payout structure for Twenty-One games using 3, 4, and 6 deck shoes, for a progressive jackpot in which each player makes a $1.00 wager to participate in the jackpot, with $0.71 of each $1.00 wager going to the jackpot, and the remaining $0.29 going to the house. The figure listed in the ODDS column gives the odds of any player on any one hand achieving the associated predetermined winning card arrangement. For example, using a 3 deck shoe, a player has one chance in 791,291 to obtain either 4 black or 4 red Aces. If 4 decks are used, the player's chances improve to one chance in 541,147.3. The total wagers for any particular cycle, with a cycle defined as the statistical number of hands until a player hits a 100% payout hand, can be calculated by multiplying the odds of the 100% payout hand by the amount of each wager accumulated to the jackpot. For example, using a 3 deck shoe, statistically, 791,291 hands must be dealt before any player obtains either 4 black or 4 red Aces. Multiplying $0.71 times 791,291 reveals that total jackpot wagers during one cycle will accumulate in the amount of $561,816.255. The figure listed in the HITS/CYCLE column is the number of times a particular winning hand will, on a statistical basis, be achieved during one cycle. The figure listed in the TOTAL PAYS column is the total payout amount that the house will pay for the associated particular winning card arrangement during one cycle.

It should be noted that Table 3 is intended as illustrative only of the statistical payouts and odds associated with one example embodiment of the invention, and should not be interpreted as limiting.

In the event that two or more players achieve winning hand combinations during the same round of the Twenty-One game, the house can adopt appropriate tie-resolving rules. For example, players winning less than the full amount of the jackpot could be paid their winning amounts and a player winning the entire amount of the jackpot would then receive the remaining jackpot amount. Thus, the jackpot amount becomes the aggregate win amount that can be won during any one round of the Twenty-One game. This is similar to the conventional rules employed in a Keno game where the total amount available to win during any one Keno game is an aggregate amount with the smaller winnings being paid first and a player winning a large payout receives whatever is left of the aggregate amount.

The new payout structure of the present invention has several advantages over prior jackpot payout structures:

1. Psychologically, players playing a game of Twenty-One place the highest value (not in terms of point count) on an Ace. Aces are widely considered to be the best cards a player can receive in a Twenty-One game.
2. The payout structure is based upon cards having the best psychological impact on a player, and therefore awards players for receiving the "best" cards.
3. The payout structure statistically permits progressive jackpots to accumulate which are on the order of $150,000.00–$200,000.00 for a $1.00 jackpot wager of which approximately $0.71 goes to the jackpot meter. Therefore, the typical amount of the progressive jackpot is higher than, for example, the progressive jackpot

TABLE 3

Progressive Twenty-One Odds And Payout Structure at $.71 to meter

| | ODDS | PAYS ($) | HITS/CYCLE | TOTAL PAYS ($) |
|---|---|---|---|---|
| 3 DECK | | | | |
| 4 black or 4 red Aces | 791,291 | 100% | 1 | 288,359.75 |
| 3 Suited Aces | 152,171 | 2,500 | 5.200008543 | 13,000.02 |
| 3 Unsuited Aces | 2,766.75 | 250 | 286 | 71,500.00 |
| 2 Suited Aces | 994.59 | 100 | 795.5946671 | 79,559.47 |
| 2 Unsuited Aces | 180.83 | 25 | 4375.880661 | 109,397.02 |
| | Total Pays (except 100%) | | | 273,456.50 |
| | Total Wagers = 791,291 × $.71 = | | | $561,816.255 |
| 4 DECK | | | | |
| 4 black or 4 red Aces | 541,147.3 | 100% | 1 | 182,582.36 |
| 3 Suited Aces | 92,391 | 2,500 | 5.857142471 | 14,642.86 |
| 3 Unsuited Aces | 2,639.74 | 250 | 205.00012084 | 51,250.05 |
| 2 Suited Aces | 897 | 100 | 603.2856745 | 60,328.57 |
| 2 Unsuited Aces | 179.4 | 25 | 3016.428372 | 75,410.71 |
| | Total Pays (except 100%) | | | 201,632.19 |
| | Total Wagers = 541,147.3 × $.71 = | | | $384,214.5475 |
| 6 DECK | | | | |
| 4 black or 4 red Aces | 391,190.5 | 100% | 1 | 118,392.62 |
| 3 Suited Aces | 62,665.5 | 2,500 | 6.242517813 | 15,606.29 |
| 3 Unsuited Aces | 2,476.94 | 250 | 157.9329737 | 39,483.24 |
| 2 Suited Aces | 808.6 | 100 | 483.7874103 | 48,378.74 |
| 2 Unsuited Aces | 175.0 | 25 | 2235.374286 | 55,884.36 |
| | Total Pays (except 100%) | | | 159,352.64 |
| | Total Wagers = 391,190.5 × $.71 = | | | $277,745.26 |

amount achieved by using the payout structures disclosed in U.S. Pat. Nos. 4,861,041 and 5,288,077.

4. The number of payouts is reduced in comparison with the prior jackpot payout structures, and therefore, the pace of the game and the number of hands per hour is increased under the new payout structure.

5. The payout structure does not affect the integrity of the underlying Twenty-One game, in that a player will not improperly play the underlying game in order to maximize his odds of winning the jackpot, or vice versa. When a player receives two Aces (with the point count of either 2 or 22—with the point of 22 being over 21, and therefore, essentially leaving the point count at 2), the player, using widely known optimal strategy, will always take a hit from the dealer. With three Aces, (and a point count of either 3 or 13), the player will always take a hit, regardless of the value of the dealer's up card. The foregoing is also true if the player "splits" the Aces. It should be appreciated that the prior payout structure disclosed in U.S. Pat. No. 5,288,077 also virtually never interferes with the proper play of the Twenty-One game, however, if a player is very unsophisticated, the player still may be tempted to make a bad play or decision under the '077 Patent payout structure, whereas the proper play upon receiving two Aces as a player's first two cards is essentially a "no brainer".

6. A payout structure in which the winning hands consist of two or more 4s, 5s, 6s, or 7s would interfere with the integrity and play of the underlying Twenty-One game in that if a player has, for example, two 7s, and the dealer has either a 4, 5, or a 6 up card, then the proper procedure in accordance with optimal Twenty-One strategy is for the player to stand, rather than take another card and try to hit three 7s, which the player might be tempted to do in order to win the jackpot.

While the invention has been described in connection with a live casino Twenty-One game, it can equally be employed in connection with video type Twenty-One games in which a plurality of video gambling machines are programmed in a well known manner to play Twenty-One, with a plurality of machines linked to a common progressive jackpot.

Further, while the preferred embodiment of the invention contemplates a progressive jackpot in which any amounts of jackpot wagers not won on a particular card hand carry over to the next, the inventive payout structure may also be employed, in a less preferred embodiment of the invention, in association with a non-progressive jackpot. A non-progressive jackpot would be one where all jackpot wagers were settled at the conclusion of each hand in accordance with a predetermined payoff table, with any portion of a jackpot wager not won by a player on that particular hand immediately taken by the house, rather than credited to a progressive jackpot amount.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

I claim:

1. A method of including a jackpot component in a Twenty-One game comprising the steps of:

a. a player making a first wager to participate in the Twenty-One game;

b. a player making a second wager to participate in the jackpot component;

c. dealing a hand of playing cards to the player;

d. if the player's hand comprises a predetermined arrangement of cards, the player wins a preselected amount of the jackpot; and e. the predetermined arrangement of cards comprises at least three Aces.

2. The method of claim 1, wherein the predetermined arrangement of cards and the preselected winning amounts are:

| Winning Hand | Amount of Jackpot |
|---|---|
| 4 black or 4 red Aces | highest amount |
| 3 suited Aces | second highest amount |
| 3 unsuited Aces | third highest amount |
| 2 suited Aces | fourth highest amount |
| 2 unsuited Aces | fifth highest amount |

3. The method of claim 1, wherein the predetermined arrangements of cards and the preselected winning amounts are:

| Winning Hand | Amount of Jackpot |
|---|---|
| 4 black or 4 red Aces | 100% |
| 3 suited Aces | 2500 tokens |
| 3 unsuited Aces | 250 tokens |
| 2 suited Aces | 100 tokens |
| 2 unsuited Aces | 25 tokens |

4. The method of claim 1, wherein the jackpot is progressive in that amounts of said second wagers not won on one hand carry over to the next hand.

5. The method of claim 1, wherein the Twenty-One game is a live casino game.

6. The method of claim 5, wherein a plurality of live casino Twenty-One games are linked to a common jackpot component.

7. The method of claim 1, wherein the Twenty-One game is played on a video type gambling machine.

8. The method of claim 7, wherein a plurality of video Twenty-One games are linked to a common jackpot component.

9. The method of claim 1, wherein the predetermined arrangement of cards comprises at least two suited Aces.

10. The method of claim 1, wherein the predetermined arrangement of cards comprises at least three suited Aces.

11. The method of claim 1, wherein the predetermined arrangement of cards comprises at least four Aces.

12. The method of claim 1, wherein the predetermined arrangement of cards comprises at least four suited Aces.

13. A method of including a jackpot component in a Twenty-One game comprising the steps of:

a. a player making a first wager to participate in the Twenty-One game;

b. a player making a second wager to participate in the jackpot component;

c. dealing a hand of playing cards to the player;

d. if the player's hand comprises a predetermined arrangement of cards, the player wins a preselected amount of the jackpot; and e. the predetermined arrangements of cards consist of:

| Winning Hand | Amount of Jackpot |
|---|---|
| 4 black, or 4 red Aces | highest amount |
| 3 suited Aces | second highest amount |
| 3 unsuited Aces | third highest amount |
| 2 suited Aces | fourth highest amount |
| 2 unsuited Aces | fifth highest amount |

14. The method of claim 13, wherein the Twenty-One game is a live casino game.

15. The method of claim 13, wherein a plurality of live casino Twenty-One games are linked to a common jackpot component.

16. The method of claim 13, wherein the Twenty-One game is a video game.

17. The method of claim 16, wherein a plurality of video Twenty-One games are linked to a common jackpot component.

18. A method of including a jackpot component in a Twenty-One game comprising the steps of:

a. affording a player an opportunity to make a first wager to participate in the Twenty-One game;

b. affording a player an opportunity to make a second wager to participate in the jackpot component;

c. dealing a hand of playing cards to the player;

d. if the player's hand comprises a predetermined arrangement of cards, the player wins a preselected amount of the jackpot; and e. the predetermined arrangement of cards comprises at least three Aces.

19. The method of claim 18, wherein the predetermined arrangement of cards and the preselected winning amounts are:

| Winning Hand | Amount of Jackpot |
|---|---|
| 4 black or 4 red Aces | highest amount |
| 3 suited Aces | second highest amount |
| 3 unsuited Aces | third highest amount |
| 2 suited Aces | fourth highest amount |
| 2 unsuited Aces | fifth highest amount |

20. The method of including a jackpot component in a Twenty-One game comprising the steps of:

a. a player making a first wager to participate in the Twenty-One game;

b. a player making a second wager to participate in the jackpot component;

c. dealing a hand of playing cards to the player;

d. if the player's hand comprises a predetermined arrangement of cards, the player wins a preselected amount of the jackpot; and e. the predetermined arrangement of cards comprises at least two different predetermined arrangements of cards which win two different corresponding preselected amounts of the jackpot, said two different predetermined arrangements of cards each comprising at least two Aces.

21. The method of claim 20, wherein said predetermined arrangement of cards comprises at least three different predetermined arrangements of cards which win three different corresponding preselected amounts of the jackpot, said three different predetermined arrangements of cards each comprising at least two Aces.

22. The method of claim 20, wherein said predetermined arrangement of cards comprises at least four different predetermined arrangements of cards which win four different corresponding preselected amounts of the jackpot, said four different predetermined arrangements of cards each comprising at least two Aces.

23. The method of claim 20, wherein said predetermined arrangement of cards comprises at least five different predetermined arrangements of cards which win five different corresponding preselected amounts of the jackpot, said five different predetermined arrangements of cards each comprising at least two Aces.

24. The method of claim 20, wherein said predetermined arrangement of cards comprises at least two different predetermined arrangements of cards which win two different corresponding preselected amounts of the jackpot, said two different predetermined arrangements of cards each comprising at least three Aces.

25. The method of claim 20, wherein said predetermined arrangement of cards comprises at least three different predetermined arrangements of cards which win three different corresponding preselected amounts of the jackpot, said three different predetermined arrangements of cards each comprising at least three Aces.

26. The method of claim 20, wherein said predetermined arrangement of cards comprises at least two different predetermined arrangements of cards which win two different corresponding preselected amounts of the jackpot, one of said two different predetermined arrangements of cards comprising at least three Aces and the other of said predetermined arrangements of cards comprising at least four Aces.

27. A method of including a jackpot component in a Twenty-One game comprising the steps of:

a. affording a player an opportunity to make a first wager to participate in the Twenty-One game;

b. affording a player an opportunity to make a second wager to participate in the jackpot component;

c. dealing a hand of playing cards to the player;

d. if the player's hand comprises a predetermined arrangement of cards, the player wins a preselected amount of the jackpot; and e. the predetermined arrangement of cards comprises at least two different predetermined arrangements of cards which win two different corresponding preselected amounts of the jackpot, said two different predetermined arrangements of cards each comprising at least two Aces.

28. A method of claim 27, wherein said predetermined arrangement of cards comprises at least three different predetermined arrangements of cards which win three different corresponding preselected amounts of the jackpot, said three different predetermined arrangements of cards each comprising at least two Aces.

29. A method of claim 27, wherein said predetermined arrangement of cards comprises at least four different predetermined arrangements of cards which win four different corresponding preselected amounts of the jackpot, said four different predetermined arrangements of cards each comprising at least two Aces.

30. A method of claim 27, wherein said predetermined arrangement of cards comprises at least five different predetermined arrangements of cards which win five different corresponding preselected amounts of the jackpot, said five different predetermined arrangements of cards each comprising at least two Aces.

31. The method of claim 27, wherein said predetermined arrangement of cards comprises at least two different predetermined arrangements of cards which win two different corresponding preselected amounts of the jackpot, said two different predetermined arrangements of cards each comprising at least three Aces.

32. The method of claim 27, wherein said predetermined arrangement of cards comprises at least three different predetermined arrangements of cards which win three different corresponding preselected amounts of the jackpot, said three different predetermined arrangements of cards each comprising at least three Aces.

33. The method of claim 27, wherein said predetermined arrangement of cards comprises at least two different predetermined arrangements of cards which win two different corresponding preselected amounts of the jackpot, one of said two different predetermined arrangements of cards comprising at least three Aces and the other of said predetermined arrangements of cards comprising at least four Aces.

* * * * *